US005487781A

United States Patent [19]

Brennan et al.

[11] Patent Number: 5,487,781

[45] Date of Patent: Jan. 30, 1996

[54] MASTIC APPLICATOR SYSTEM

[75] Inventors: Thomas J. Brennan, Rochester Hills; Michael E. DeFillipi, Grosse Pointe Park; Steven M. Gnyp, Grosse Pointe; Gregory D. Kremer, Livonia, all of Mich.

[73] Assignee: Johnstone Pump Company, Troy, Mich.

[21] Appl. No.: 243,697

[22] Filed: May 17, 1994

[51] Int. Cl.[6] ..... B05D 9/00

[52] U.S. Cl. ..... 118/300; 118/302; 118/600; 239/139

[58] Field of Search ..... 118/300, 302, 118/600; 239/132.1, 139, 548, 552, 553.5, 601; 137/3, 13, 340; 251/367

[56] References Cited

U.S. PATENT DOCUMENTS

| | | | |
|---|---|---|---|
| Re. 34,561 | 3/1994 | Zaber | 118/302 |
| 1,247,937 | 11/1917 | Cumfer | 165/144 |
| 2,316,376 | 4/1943 | Weiss | 62/141 |
| 2,410,912 | 11/1946 | Wenk | 285/133.1 |
| 2,530,799 | 11/1950 | Arvintz et al. | 392/495 |
| 2,658,527 | 11/1953 | Kaiser | 137/340 |
| 2,707,313 | 5/1955 | McShurley et al. | 137/563 |
| 2,762,652 | 9/1956 | Carter | 118/302 |
| 2,762,901 | 9/1956 | Liedberg | 392/481 |
| 2,827,330 | 3/1958 | Baur | 239/132.1 |
| 2,834,368 | 5/1958 | Gray | 251/367 |
| 3,105,708 | 10/1963 | Esty | 285/41 |
| 3,146,950 | 9/1964 | Lancaster | 239/128 |
| 3,194,257 | 7/1965 | Stephens | 251/367 |
| 3,690,292 | 9/1972 | Pasley, Sr. | 118/59 |
| 3,880,228 | 4/1975 | Houk et al. | 165/30 |
| 3,934,618 | 1/1976 | Henderson | 138/114 |
| 4,018,362 | 4/1977 | Ubaud | 222/55 |
| 4,029,094 | 6/1977 | Winicki | 604/67 |
| 4,628,861 | 12/1986 | Mitchell | 118/684 |
| 4,662,540 | 5/1987 | Schroter | 222/55 |
| 4,667,852 | 5/1987 | Siemann | 222/54 |
| 4,890,573 | 1/1990 | Zaber | 118/667 |
| 4,922,852 | 5/1990 | Price | 118/683 |
| 4,989,756 | 2/1991 | Kagamihara et al. | 222/55 |
| 4,998,502 | 3/1991 | Schucker | 118/667 |
| 5,029,731 | 7/1991 | Klatt | 222/54 |
| 5,146,946 | 9/1992 | Mougans | 137/340 |
| 5,287,913 | 2/1994 | Dunning et al. | 165/26 |
| 5,312,016 | 5/1994 | Brennen et al. | 222/55 |
| 5,363,907 | 11/1994 | Dunning et al. | 239/139 |

FOREIGN PATENT DOCUMENTS

| | | |
|---|---|---|
| 453052 | 8/1936 | United Kingdom . |

*Primary Examiner*—Robert J. Warden
*Assistant Examiner*—Theresa T. Snider
*Attorney, Agent, or Firm*—Young, MacFarlane & Wood

[57] ABSTRACT

A mastic applicator system for delivering a mastic material to a surface in a precisely controlled manner. The system includes a mastic pump, a regulator receiving the mastic from the pump, a nozzle, and a jacketed hose assembly interconnecting the regulator output and the nozzle input. The hose assembly includes an end block having a flat sealing surface, and the end block and the body of the nozzle are fixedly secured together with the sealing surface on the end block in flush sealing contiguous relation to a flat sealing surface on the nozzle body so that a mastic passage and water passages in the end block may respectively sealingly communicate with a mastic passage and water passages in the nozzle body at the sealing surfaces. The mastic passage from the hose assembly to the nozzle outlet is thus totally internal and totally insulated so as to preclude the formation of cold plugs of mastic material during system shut down. Further, the water passages in the end block and nozzle body are arranged in encircling relation to the mastic passage as it passes through the end block and nozzle body so that the temperature of the mastic flowing through the end block and nozzle body may be carefully and precisely controlled by controlling the temperature of the water passing through the water passages.

17 Claims, 5 Drawing Sheets

MASTIC APPLICATOR SYSTEM

BACKGROUND OF THE INVENTION

This invention relates to a system for applying a mastic material to a surface.

The term "mastic material" is intended to cover any of various pasty substances used as coatings or adhesives. For example, mastic materials are finding increasing application in the automotive field and specifically are finding -increasing application in facilitating the attachment of plastic automotive body panels to steel skeletons to form the automotive body.

The mastic is typically delivered to the surface through a nozzle in a fan spray pattern so that as the nozzle is moved, for example under the control of a robot, along the surface a mastic coating is applied to the surface conforming to the geometry of the fan spray pattern. It is important for quality control purposes that the fan spray pattern and thereby the spray footprint be maintained substantially constant. Since the fan spray pattern is largely dependent on the temperature of the mastic being delivered to the nozzle, it is critical that the mastic be delivered to the nozzle from the remote mastic supply location at a substantially uniform temperature. Whereas mastic applicator systems have been developed and utilized which attempt to maintain a constant mastic temperature at the nozzle irrespective of significant distances between the mastic source and the nozzle, none of these prior art systems have been totally successful in maintaining a uniform mastic temperature at the nozzle under all operating conditions.

SUMMARY OF THE INVENTION

This invention is directed to the provision of an improved mastic applicator system.

More specifically this invention is directed to the provision of a mastic applicator system which functions to deliver mastic to the nozzle of the system at a uniform temperature under all operating conditions.

The invention mastic applicator system includes a conduit assembly including a mastic passage, an end member including a mastic passage receiving the mastic material from the conduit assembly mastic passage, and a nozzle assembly including a nozzle outlet and a mastic passage in communication with the end member mastic passage and the nozzle outlet.

According to the invention, a conditioning fluid passage is provided in the conduit assembly proximate the conduit assembly mastic passage; a further conditioning fluid passage is provided in the end member proximate the end member mastic passage; a yet further conditioning fluid passage is provided in the nozzle assembly proximate the nozzle assembly mastic passage; and the conditioning fluid passages in the conduit assembly, the end member, and the nozzle assembly are arranged in serial fashion so that a conditioning fluid may flow serially through the tube assembly, the end member, and the nozzle assembly in proximity to the respective mastic passages so as to maintain a substantially constant mastic temperature in the entire mastic applicator system.

According to a further feature of the invention, the nozzle assembly includes a nozzle body defining the nozzle assembly mastic passage and a nozzle assembly conditioning fluid passage; the nozzle body defines a large area sealing surface; the end member defines a large area sealing surface corresponding generally to the nozzle body sealing surface; and the end member and nozzle body are fixedly secured together with the end member sealing surface in flush sealing contiguous relation to the nozzle body sealing surface and with one end of the end member mastic passage communicating at the sealing surface interface with one end of the nozzle body mastic passage. This arrangement ensures that there are no exposed areas of the mastic passage and further facilitates the use of the conditioning fluid passages to maintain a substantially constant mastic temperature in the entire mastic applicator system.

According to a further feature of the invention, one end of the end member conditioning fluid passage communicates at the sealing surface interface with one end of the nozzle body conditioning fluid passage. This arrangement facilitates the smooth, serial flow of the conditioning fluid through the system and maintains the conditioning fluid passages in proximity to the respective mastic passages.

According to a further feature of the invention, the nozzle is operative to generate a plurality of streams of mastic which are spaced apart by a distance calculated to enable the streams to coact upon impact with a surface, and with the mastic maintained at a desired predetermined temperature, to form a single continuous bead of substantially uniform height. This arrangement allows a plurality of spaced streams to be utilized, knowing the given predetermined and constant mastic temperature, to form a single continuous bead of substantially uniform height.

According to a further feature of the invention, the end body defines a further internal conditioning fluid passage opening at one end thereof in the end body sealing surface and opening at its other end in a further surface of the end body; with the end body and nozzle body secured together with the sealing surfaces in flush, sealing, contiguous relation, one end of the further end body conditioning fluid passage is in sealing communication with one end of the nozzle body conditioning fluid passage; and the other end of the further end body conditioning fluid passage is in communication with the source of conditioning fluid. This arrangement further facilitates the precise temperature control of the mastic flowing through the end body of the conduit assembly by introducing the conditioning fluid into the nozzle body through the end body.

In the disclosed embodiment of the invention, the end body of the conduit assembly comprises an end block defining a flat sealing surface for flush, sealing, contiguous engagement with a flat sealing surface on the nozzle body, and the conduit assembly includes a jacketed hose assembly including an inner hose for carrying the mastic and an outer hose fitted over a circular mounting surface on the end block and coacting with the inner hose to define an annular chamber for carrying the conditioning fluid.

DETAILED DESCRIPTION OF THE PREFERRED EMBODIMENT

Figures 1, 6:
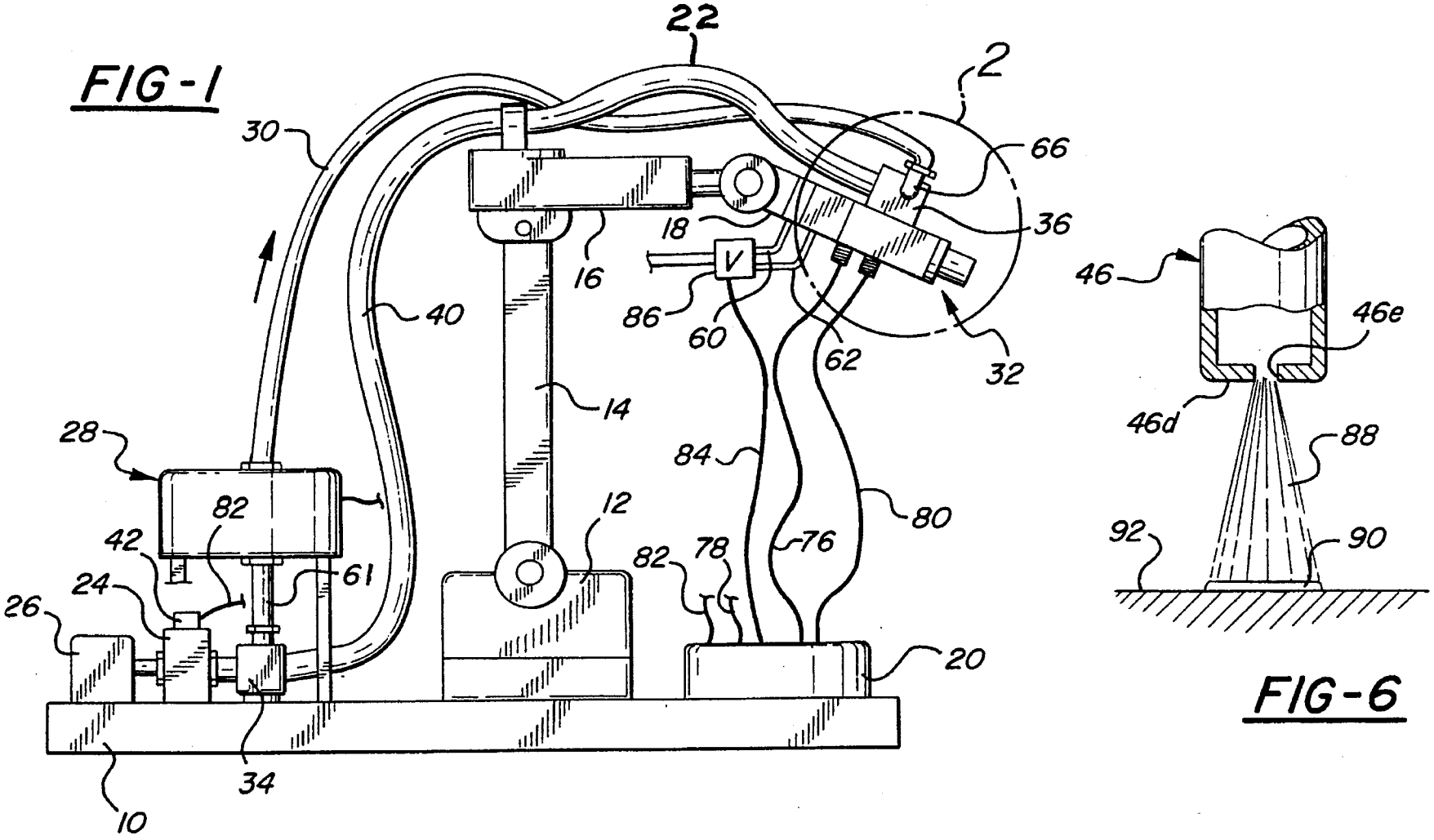
FIG. 1 is a somewhat schematic view of the invention mastic applicator system utilized in conjunction with a robotic assembly.
FIGS. 6 and 7 are detail views illustrating the manner in which the mastic material is supplied to form a bead on the surface.

The invention mastic applicator system is illustrated in FIG. 1 in conjunction with a robotic assembly including a base 10, a pedestal 12 mounted for rotary movement on the base, a mast 14 pivotally mounted on the pedestal; a boom 16 pivotally mounted on the upper end of the mast; an applicator arm 18 pivotally secured to the free end of the boom 16; and a controller 20 operative to control the robotic assembly in accordance with any predetermined pattern or program.

The invention mastic applicator system includes a hose assembly 22, a regulator 24, a pump 26, a water conditioner 28, a water hose 30, and a nozzle assembly 32.

Figure 2:
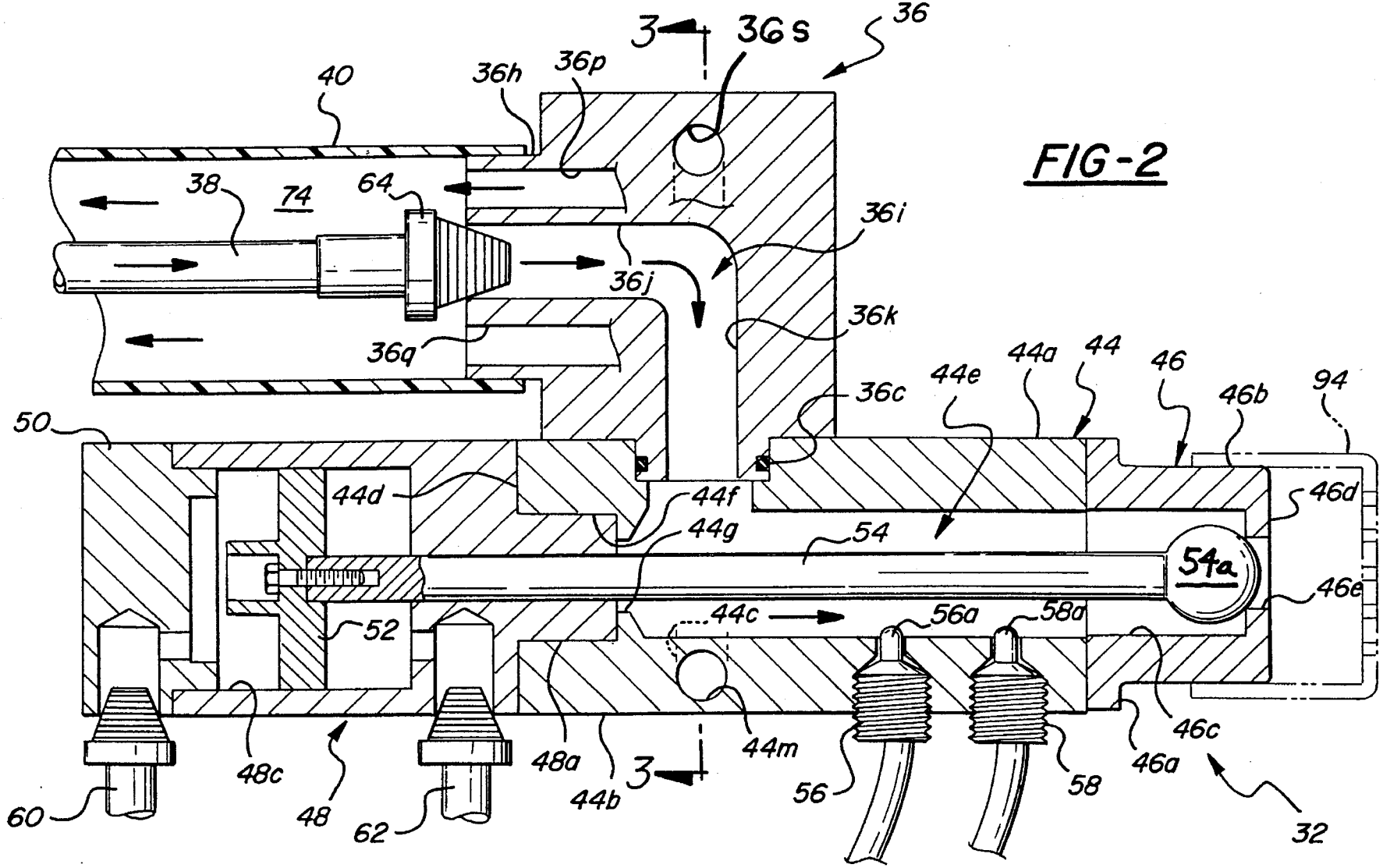
FIG. 2 is a detail view taken within the circle 2 of FIG. 1.

Hose assembly 22 includes an inlet end block 34, a discharge end block 36, an inner hose 38, (FIG. 2) and an outer hose 40.

Inlet end block 34 may be suitably positioned, for example, on the base 10 of the robotic assembly and is arranged to receive the inlet ends of outer hose 40 and inner hose 38.

Figure 4:
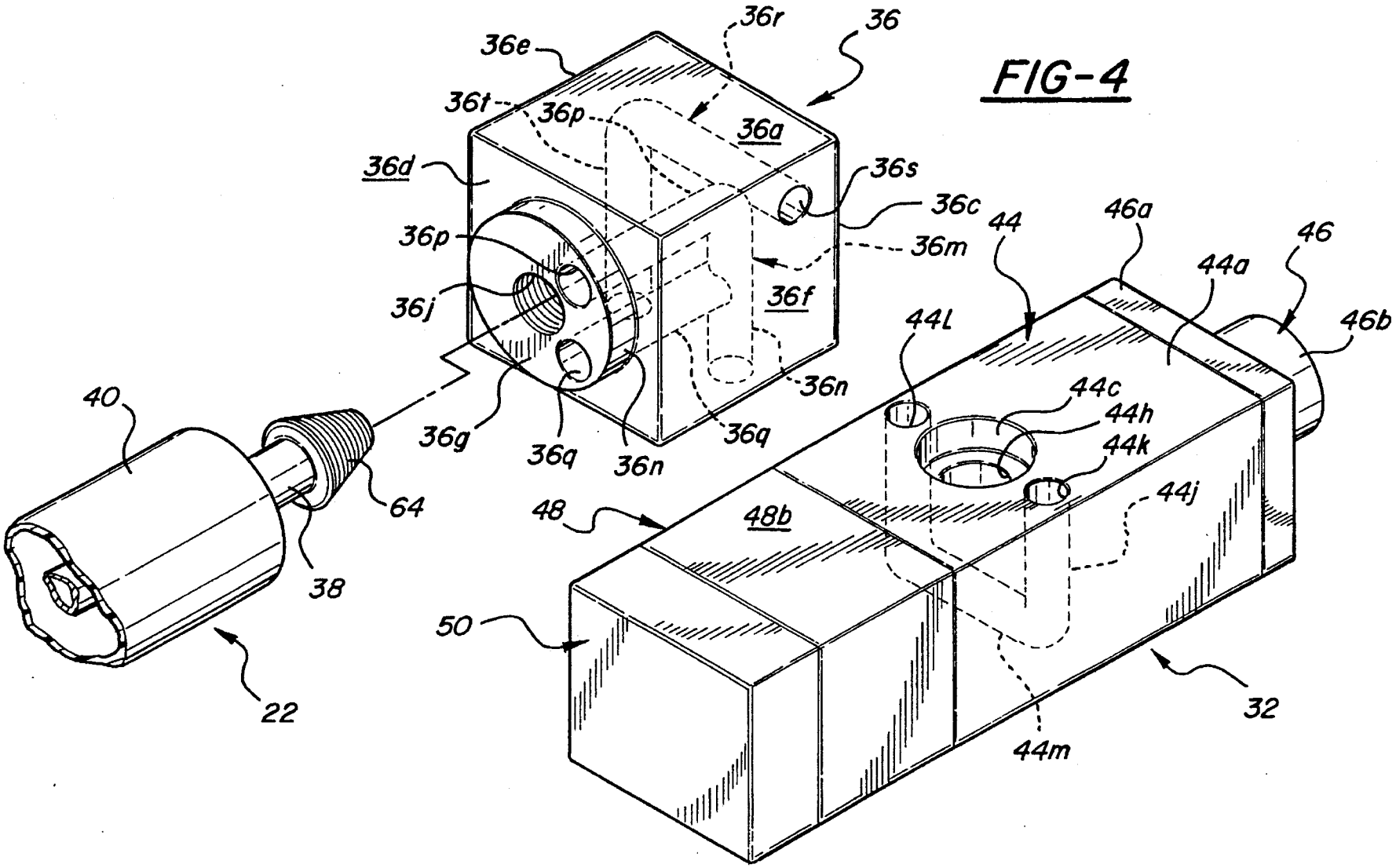
FIG. 4 is an exploded perspective view of a jacketed hose assembly and nozzle assembly utilized in the invention mastic applicator system.

Discharge end block 36 (FIGS. 2 and 4) includes an upper surface **36*a*, a lower surface 36*b*, a front surface 36*c*, a rear face 36*d*, a left side face 36*e*, and a right side face 36*f***.

A reduced diameter circular mounting portion **36*g* is formed on the rear face 36*d* of the end block and defines a circular mounting surface 36*h* sized to receive the discharge end of the outer hose 40 of the hose assembly with a hose clamp (not shown) arranged in known manner to firmly clamp the end of the hose 40 to the surface 36*h***.

End block 36 further defines a mastic passage **36*i* of L configuration and including a central horizontal passage portion 36*j* opening in the rear face 36*d* of the end block within the mounting surface 36*h* and a vertical portion 36*k* opening at its lower end in a circular boss 36*l* projecting from the lower face 36*b*** of the end block.

Block 36 further defines an internal discharge water passage **36*m* of F configuration and including a vertical portion 36*n* opening in the lower face 36*b* of the end block in laterally spaced relation to boss 36*l* and a pair of horizontal portions 36*p* and 36*q* opening in the end face 36*d* within the mounting surface 36*h* and in laterally spaced relation to passage portions 36*j***.

End block 36 further defines a water inlet passage **36*r* including a horizontal portion 36*s* opening in right side face 36*f* and a vertical portion 36*t* opening in the lower face 36*b* in laterally spaced relation to the openings formed by passage portions 36*k* and 36*n*. Openings 36*n* and 36*t* will be seen to be positioned on either side of opening 36*k* and to lie on a common centerline with opening 36*k***.

Regulator 24 (FIG. 1) may be positioned for example on the base 10 of the robotic assembly and may comprise for example a regulator of the type shown in U.S. Pat. No. 5,312,016. Regulator 24 is arranged to receive mastic material from pump 26 and deliver it to inlet end block 34 of the hose assembly and includes an air valve 42 which operates to control a valving member within the regulator and thereby control the volume and/or pressure of the mastic being delivered to the inlet end block 34 by the regulator.

Pump 26 may be mounted for example on the base 10 of the robotic assembly and may for example comprise an adhesive pump available from Johnstone Pump Co. of Troy, Mich. as Part No. 1001-S1-10-HDE.

Water conditioner 28 may take any of various forms and includes means to selectively heat and/or cool water delivered thereto in accordance with commands from the controller 20.

Nozzle assembly 32 includes a nozzle body 44, a nozzle 46, a cylinder housing 48, a cylinder cap 50, a piston 52, a stem 54, a temperature sensor 56, and a pressure sensor 58.

Nozzle body 44 has a block configuration and includes an upper face **44*a*, a lower face 44*b*, a front face 44*c* and a rear face 44*d***.

Nozzle body 44 defines a central mastic passage **44*e* opening in the front face 44*c* of the body, a bore 44*f* opening in the rear face 44*d* of the body in axial alignment with passage 44*e*, a bore 44*g* connecting bore 44*f* and passage 44*e*, a vertical passage 44*h* communicating with mastic passage 44*e*, and a counterbore 44*i* opening in the upper face 44*a*** of the nozzle body.

Nozzle body 44 further defines a water conduit **44*j* of U configuration and including vertical portions 44*k* and l opening in nozzle body upper face 44*a* in flanking relation to counterbore 44*i* and a central horizontal portion 44*m* interconnecting the lower ends of portions 44*k* and 44*l* and passing beneath mastic bore 44*e*. Bores 44*l*, 44*i* and 44*k* lie on a common centerline and correspond to the pattern of bores 36*n*, 36*k*, and 36*t* in the lower face of end block 36**.

Nozzle 46 (FIGS. 2 and 6) will vary in configuration depending upon the desired pattern of the mastic bead to be formed. The illustrated nozzle 46 includes a flange portion **46*a* secured to the front face 44*c* of the nozzle body and a cylindrical portion 46*b* defining an interior bore 46*c* aligned with mastic bore 44*e* of the nozzle body and including an end wall 46*d* defining a nozzle outlet 46*e***.

Cylinder housing 48 (FIG. 2) is secured to the rear face **44*d* of the nozzle body and includes a fitting 48*a* fitted into bore 44*f* of the nozzle body and a main body portion 48*b* defining a central cylindrical bore 48*c* for sliding receipt of piston 52**.

Cylinder cap 50 is secured to the rear end of cylinder housing 48 and serves to close off the rear end of cylindrical bore **48*c***.

Stem 54 is secured at its rear end to piston 52 and extends through a central bore in cylinder housing 48 and through mastic passage **44*e* to define a ball 54*a* at its forward end for coaction with the nozzle outlet 46*e* to turn on or shut off the nozzle in accordance with reciprocal movement of piston 52 as determined by air under pressure admitted to the front and rear faces of the piston through air conduits 60 and 62**

Temperature sensor 56 is positioned in the lower face **44*b* of the nozzle body 44 and includes a probe 56*a* projecting into the mastic passage 44*e*, and pressure sensor 58 is similarly positioned in the lower face 44*b* of the nozzle body and includes a probe 58*a* projecting into the mastic passage 44*e***.

In the assembled relation of the mastic applicator system (FIGS. 1 and 2), pump 26 is arranged to deliver its mastic output to the inlet of regulator 24; regulator 24 is arranged to deliver its regulated mastic output to end block 34; outer hose 40 and inner hose 38 are secured at one end thereof to end block 34; a water conduit 61 extends between end block 34 and the inlet of water conditioner 28; nozzle assembly 32 is secured to robot applicator arm 18 so that the nozzle may be moved by the robot in accordance with programs embodied in the controller 20; end block 36 is fixedly secured to nozzle body 34 by bolts 63 passing through the nozzle body for engagement with threaded bores in the end block; the inlet end of outer hose 40 is mounted on the mounting surface 36*h* of end block 36; the discharge end of inner hose 38 is fixedly positioned in passage portion 36*j* utilizing a suitable fitting 64; and water hose 30 extends from the outlet of water conditioner 28 to end block 36 where it is fixedly secured to water passage 36*s* utilizing a fitting 66.

Figure 5:
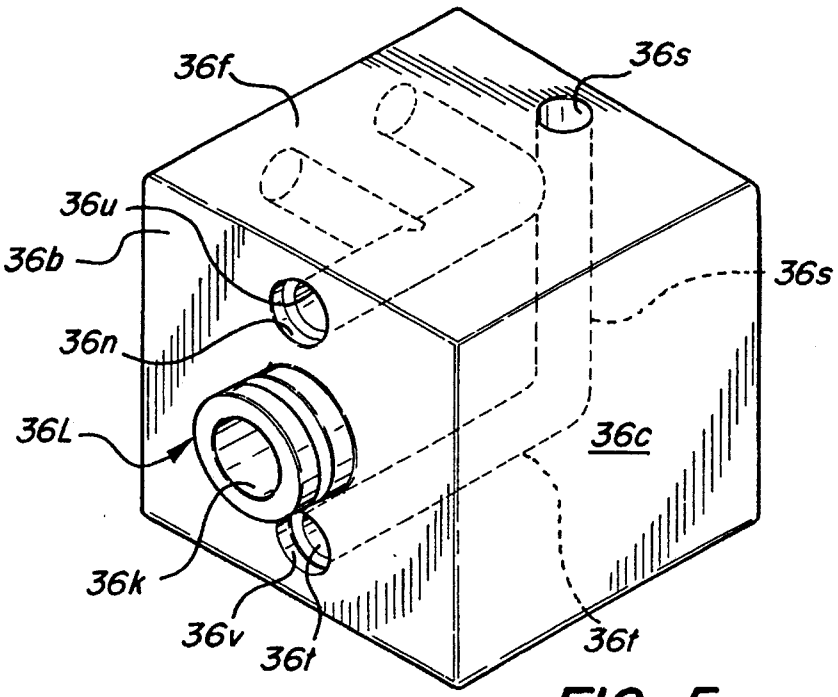
FIG. 5 is a perspective view of an end block forming a part of the jacketed hose assembly.

In the assembled relation of end block 36 and nozzle body 34 (FIGS. 2 and 5) boss 361 is positioned in counterbore 44*i* with an O-ring 68 positioned in a circumferential groove in the boss 361 sealingly engaging counterbore 44*i*; water passage 36*n* in end block 36 is vertically aligned with water passage 44*k* in nozzle body 44 with an O-ring 70 positioned in a groove 36*u* provided as a counterbore in the lower end of passage 36*n*; and the lower end of end block water passage 36*t* is vertically aligned with nozzle body water passage 441 with an O-ring 72 positioned in a counterbore groove 36*v* formed at the lower end of bore 36*t*.

Thus assembled, it will be seen that passages 36*j*, 36*k*, 44*h*, 44*e* and 46*c* coact to define a continuous internal insulated mastic passage extending from the inner hose fitting 64 to the nozzle outlet 46*e*, and passages 36*s*, 36*t*, 44*l*, 44*m*, 44*k*, 36*n*, 36*q* and 36*p* coact to define a continuous internal water passage extending from fitting 66 to the annular chamber 74 defined between outer hose 40 and inner hose 38.

It will further be seen that the lower face 36*b* of end block 36 (FIG. 5) comprises a flat sealing surface which is fixedly secured in flush, sealing, contiguous relation to the sealing surface constituted by the flat upper face 44*a* of nozzle body 44 so that the sealing surfaces coact in combination with O-rings 68, 70 and 72 to provide insulated, sealed, communication between the water and mastic passages in the end block and the corresponding water and mastic passages in the nozzle body.

Specifically, the mastic passage extending through the end body and through the nozzle body is totally insulated and totally internal with no exposure to atmospheric conditions, and the water passage extends through the end body and through the nozzle body in surrounding relation to the mastic passages so that the temperature of the mastic material flowing from the inner hose fitting 64 to nozzle outlet 46*e* may be carefully and precisely controlled to maintain a constant uniform mastic temperature between the fitting 64 and nozzle outlet 46*e*.

In operation, it will be understood that mastic is continuously delivered from pump 26 through regulator 24, end block 34, inner hose 38, fitting 64, mastic passage 36*i* and mastic passages 44*e* and 46*c* for discharge from nozzle outlet 44*e*; conditioning water is continuously circulated from water conditioner 28 through water hose 30, through fitting 66 to water passage 36*s*, through water passages 36*t*, 44*l*, 44*m*, 44*k*, 36*n*, 36*p* and 36*q* for delivery to annular hose chamber 74, through annular hose chamber 74 to inlet end block 34 and then through water pipe 60 to the inlet of water conditioner 28; the temperature of the mastic flowing through master chamber 44*e* is constantly sensed by the probe 56*a* of temperature sensor 56 and probe 56*a* functions to generate an output signal which is communicated to controller 20 via lead 76; controller 20 compares the signal from lead 76 to a comparison signal corresponding to a desired mastic temperature and transmits a control signal via a lead 78 to water conditioner 28; water conditioner 28 functions in response to the control signal received via lead 78 to selectively heat or cool the water flowing therethrough so as to maintain the desired mastic temperature flowing through mastic bore 44*e*; pressure sensor 58 constantly senses the pressure of mastic flowing through mastic bore 44*e* and generates an output signal for transmittal to controller 20 via lead 80; controller 20 compares the pressure signal received on lead 80 from pressure sensor 58 to a desired comparison pressure signal and generates a control signal on lead 82 for transmittal to the air control valve 42 of the regulator 24; and air control valve 42 functions in response to receipt of the control signal on lead 82 (and as described in further detail in U.S. Pat. No. 5,312,016 to selectively vary the setting of the valving member of the regulator to selectively vary the pressure of the mastic flowing through the system. Controller 20 also functions via a lead 84 to control a solenoid valve 86 so as to selectively control the delivery of air to conduits 60 and 62 and selectively move piston 52 forwardly or rearwardly within cylindrical bore 48*c* and selectively open and close the nozzle outlet 46*e* utilizing the stem ball 54*a*.

Since the invention mastic applicator system defines a mastic passage that is never exposed to atmosphere by virtue of the fact that the mastic is at all times positioned in a carefully temperature controlled environment by virtue of the internal nature of the mastic passage and the surrounding relation of the water conduits in the end block 36 and in the nozzle body, the temperature of the mastic arriving at the nozzle outlet 46*e* may be maintained constant at all times even in situations where the delivery of mastic must be terminated for a period of time.

Figure 7:
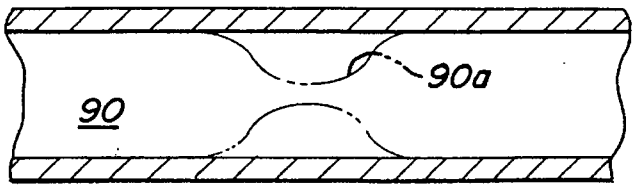
Figure 3:
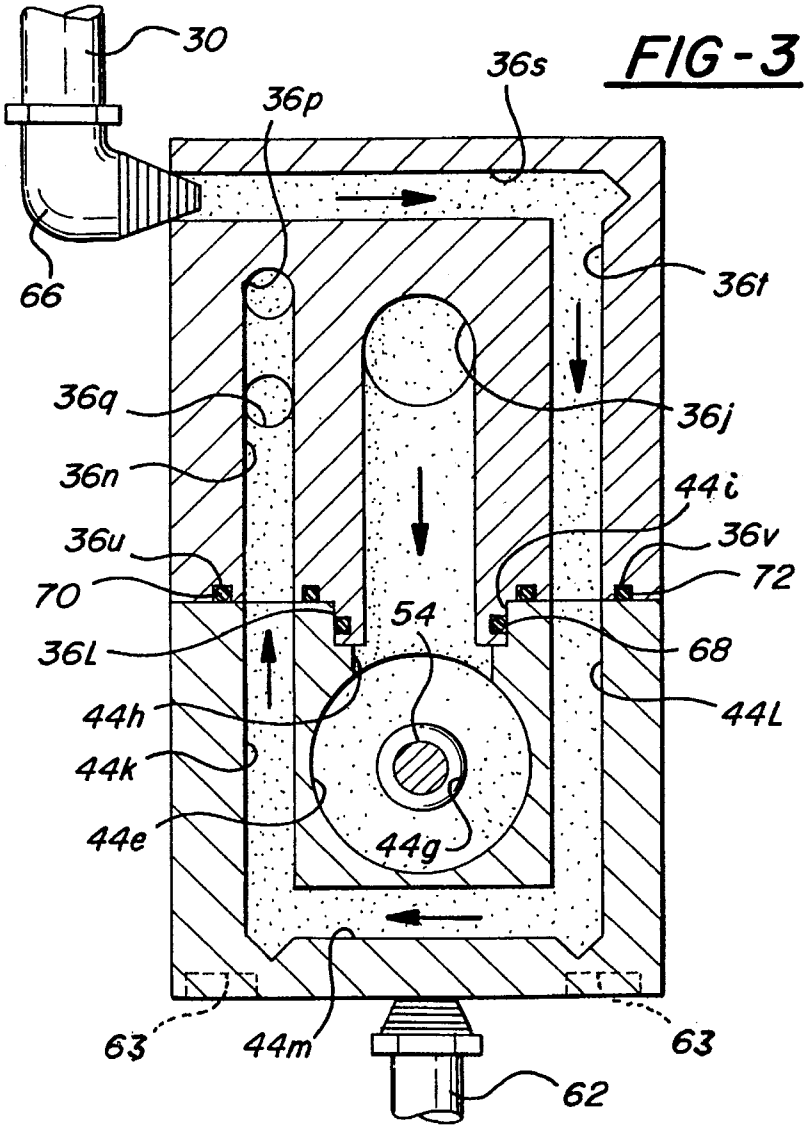
FIG. 3 is a cross sectional view taken on line 3—3 of FIG. 2.

It will be understood that the mastic is delivered from the nozzle aperture 46*e* in a fan spray pattern as seen in FIG. 6 to form a bead 90 on a surface 92. The fan spray pattern 88 is determined by the temperature of the mastic arriving at the nozzle outlet 46*e* and, specifically, the fan spray pattern will widen or narrow depending upon the temperature of the mastic arriving at the nozzle outlet 46*e*. For example, and as seen in dashed lines in FIG. 7, if the temperature of the mastic arriving at the nozzle suddenly drops the fan spray pattern will narrow to form the narrow portion 90*a* of the bead 90. The arrival of relatively cold mastic at the nozzle outlet 46*e* may be occasioned for example by shut-down of the system for a period of time allowing a portion of the mastic in the system to be exposed to atmosphere (as for example mastic material residing in exposed fittings or joints between the elements of the system). When this blob of exposed and relatively cool mastic thereafter arrives at the nozzle outlet 46*e* following resumption of system operation, the spray pattern 88 is significantly diminished so as to form the diminished bead width 90*a*. In the invention system, even in situations when the system is shut down for a period of time, there is never any portion of the mastic in the mastic feed path exposed to atmosphere so that all of the mastic is maintained at a constant temperature in the feed path even during periods of system shut down so that, when the system is thereafter started up, all of the mastic thereafter arriving at the nozzle outlet will continue to be at the uniform desired controlled temperature so that bead width variations as shown at 90*a* will not occur.

In addition to allowing precise control of the bead footprint in all operating conditions, the invention mastic applicator system also allows bead forming techniques to be utilized that would not be feasible without the precise mastic temperature control provided by the present invention. For example, and as seen in FIGS. 8–11, the applicator system may further include a specialized auxiliary nozzle 94 which fits over nozzle 46 (as seen in dash lines in FIG. 2) and includes a series of nozzle openings 94*a* formed in a predetermined pattern (for example circular as shown) in the nozzle end wall 94*b*. The series of nozzle openings 94*a* may be utilized to provide a series of nozzle streams 96 emanating respectively from the nozzle openings 94*a* with the spacing between the streams 96 carefully controlled so that, given a precisely controlled constant temperature of mastic, as the streams strike the surface 92 they are enlarged to form foot portions 96*a* which will coact and fuse together to form a uniform constant height mastic footprint or bead 98 having a shape (for example circular) generally corresponding to the shape of the predetermined pattern of the nozzle openings 94*a*.

Figure 11:
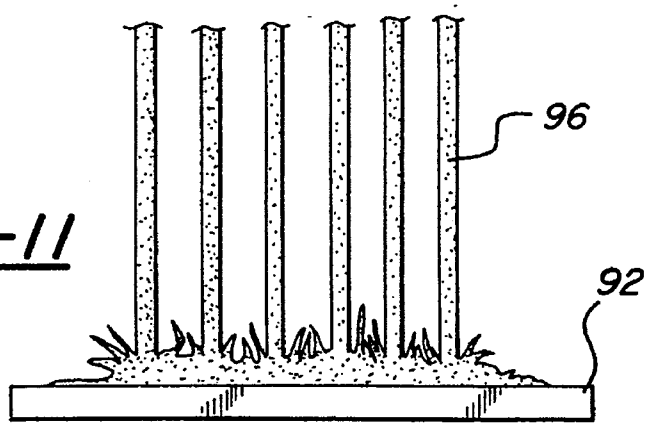
Figure 8:
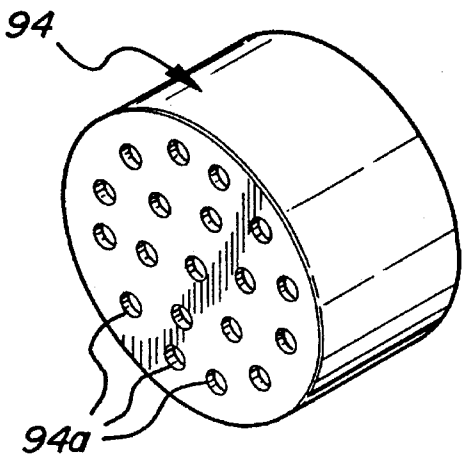
Figure 10:
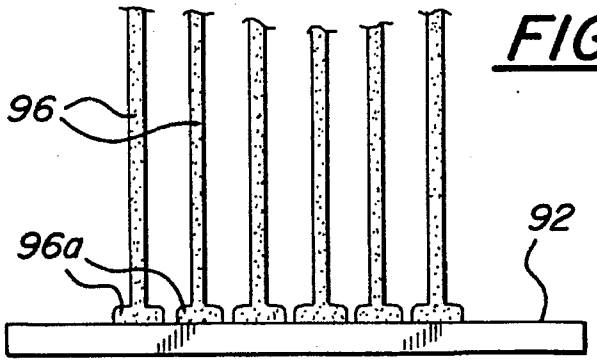

The formation of a constant height footprint utilizing this technique is critically dependent on maintaining a constant known temperature of the mastic flowing in the streams 96 since the size and configuration of the foot portions 96*a* formed by the streams as they strike the surface will vary significantly depending upon the temperature of the mastic material. For example, and as seen in FIG. 10, if the temperature of the mastic material flowing through the streams 96 drops significantly below the desired control temperature, the foot portions 96*a* of the streams will shrink in size with the result that a continuous bead will not be formed but rather a series of narrow unconnected beads will be formed. As a further example, and as seen in FIG. 11, if the temperature of the mastic material in the streams 96 increases significantly from the desired controlled value, the mastic will "splash" as it strikes the surface with the result that the footprint of the bead will have an erratic, irregular shape.

Figure 9:
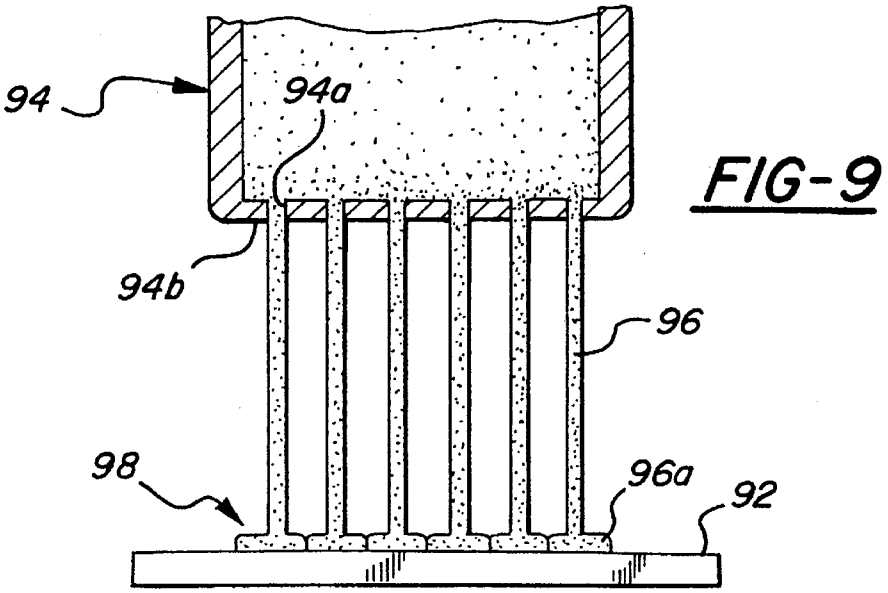
FIGS. 8–11 are detail views showing a modified nozzle configuration.

As noted, the present invention, by virtue of providing the ability to carefully and precisely control the temperature of the mastic arriving at the nozzle outlet, makes possible a bead forming technique such as seen in FIG. 9 wherein individual streams are projected from the nozzle in a pattern that is predetermined, given a carefully controlled mastic temperature, to coact upon striking the surface to produce a complete uniform mastic bead of uniform height and constant footprint.

The invention mastic control system will be seen to provide the ability to deliver a mastic bead of uniform configuration under virtually all operating conditions.

Whereas preferred embodiments of the invention has been illustrated and described in detail, it will be apparent that various changes may be made in the disclosed embodiment without departing from the scope or spirit of the invention.

We claim:

1. A mastic applicator system including a conduit assembly including a mastic passage, an end member including a mastic passage in communication with the conduit assembly mastic passage, and a nozzle assembly including a nozzle outlet and a mastic passage in communication with the end member mastic passage and the nozzle outlet, the improvement comprising:

a conditioning fluid passage Is provided in the conduit assembly proximate the conduit assembly mastic passage;

a further conditioning fluid passage is provided in the end member proximate the end member mastic passage;

a yet further conditioning fluid passage is provided in the nozzle assembly proximate the nozzle assembly mastic passage; and the conditioning fluid passage of said conduit assembly, said end member, and said nozzle assembly are arranged in serial fashion so that a conditioning fluid may flow serially through the conduit assembly, end member, and nozzle assembly in proximity to the respective mastic passages so as to maintain a substantially constant mastic temperature in the entire mastic applicator system.

2. A mastic applicator system according to claim 1 wherein;

the nozzle assembly includes a nozzle body defining the nozzle assembly mastic passage and the nozzle assembly conditioning fluid passage;

the nozzle body defines a sealing surface;

the end member defines a sealing surface corresponding generally to the nozzle body sealing surface; and the end member and nozzle body are fixedly secured together with the end member sealing surface in flush, sealing, contiguous relation to the nozzle body sealing surface and with one end of the end member mastic passage communicating at the sealing surface interface with one end of the nozzle body mastic passage

3. A mastic applicator system according to claim 2 wherein:

one end of the end member conditioning fluid passage communicates at the sealing surface interface with one end of the nozzle body conditioning fluid passage.

4. In a mastic applicator assembly comprising an end member body defining a mastic passage extending through the end member body, a conduit assembly including a mastic passage in communication with one end of the end member body mastic passage, and a nozzle assembly including a nozzle and a nozzle body defining a mastic passage communicating at one end thereof with the nozzle, the improvement comprising:

the end member body defines a sealing surface;

the other end of the end member body mastic passage opens in the sealing surface;

the nozzle body defines a sealing surface substantially corresponding to the end member body sealing surface;

the other end of the nozzle body mastic passage opens in the nozzle body sealing surface; and the end member body and nozzle body are fixedly secured together with said end member body sealing surface in flush, sealing, contiguous relation to said nozzle body sealing surface and the other end of said nozzle body mastic passage sealingly communicating with the other end of the end member body mastic passage at the interface of the sealing surfaces.

5. A mastic applicator assembly according to claim 4 wherein the system further includes conditioning means operative to maintain the mastic temperature substantially constant as the mastic flows through the conduit assembly mastic passage and through the end member body mastic passage.

6. A mastic applicator system according to claim 5 wherein:

the conditioning means comprises a conditioning fluid passage extending through the conduit assembly in proximity to the conduit assembly mastic passage and a conditioning fluid passage extending through the end member body in proximity to the end member body mastic passage and opening in the end member body sealing surface; and the nozzle body further defines a nozzle body conditioning fluid passage in proximity to the nozzle body mastic passage and opening in the nozzle body sealing surface in fluid communication with the end member body conditioning fluid passage.

7. In an applicator system for applying a mastic bead to a surface, the system comprising a conduit assembly including a mastic passage, an end body secured to the conduit assembly and including a mastic passage communicating with the conduit assembly mastic passage and a nozzle assembly including a nozzle body defining a mastic passage communicating with the mastic passage of the end body and a nozzle for receipt and dispensing of mastic fluid flowing through the mastic passage of the nozzle body, the improvement comprising:

the system includes conditioning means for maintaining the mastic flowing through the conduit assembly, end body, and nozzle body at a predetermined temperature; and the nozzle is operative to generate a plurality of independent, free-standing streams of mastic which are spaced apart by a distance calculated to enable the streams to coact upon impact with the surface, and with the mastic maintained at the predetermined temperature, to form a single continuous bead of substantially uniform height.

8. An applicator system according to claim 7 wherein:

the nozzle includes a series of nozzle openings arranged in a predetermined pattern and each operative to form a respective mastic stream; and the nozzle openings are uniformly spaced apart by a distance calculated to enable the streams to coact upon impact with the surface, and with the mastic material at the predetermined temperature, to form a single, continuous bead corresponding in shape to the predetermined pattern and having a substantially uniform height.

9. In a mastic applicator system including a source of conditioning fluid a conduit assembly including a mastic conduit for carrying mastic and a conditioning fluid conduit paralleling the mastic conduit in close proximity thereto so that conditioning fluid flowing through the conditioning fluid conduit may condition the mastic fluid with the mastic flowing through the mastic conduit; and a nozzle assembly for delivering mastic to a surface and including a nozzle defining a nozzle outlet and a nozzle body defining an internal mastic passage communicating at one end thereof with the nozzle outlet, the improvement comprising:

a conditioning fluid internal passage extends through said nozzle body in proximity to said nozzle body mastic passage; the other end of the nozzle body mastic passage opens in a nozzle body exterior surface; said conduit assembly is secured to said exterior surface of said nozzle body with one end of said conduit assembly mastic conduit in sealing communication with the other end of the nozzle body mastic passage and one end of said conduit assembly conditioning fluid conduit in sealing communication with one end of said nozzle body conditioning passage; and the other end of said nozzle body conditioning fluid passage communicates with said source of conditioning fluid.

10. In a mastic applicator system including a jacketed hose assembly including a central inner hose for carrying mastic, an outer hose coacting with the inner hose to define an annular chamber for carrying a conditioning fluid, and an end body mounting one end of the inner and outer hoses and defining an internal mastic passage communicating at one end thereof with the inner hose and an internal conditioning fluid passage communicating at one thereof with the annular chamber; and a nozzle assembly for delivering mastic to a surface and including a nozzle defining a nozzle outlet and a nozzle body defining an internal mastic passage communicating at one end thereof with the nozzle outlet, the improvement comprising:

the other end of said end body mastic passage opens in a sealing surface of the end body; the other end of said end body conditioning fluid passage opens in said end body sealing surface; a conditioning fluid internal passage is provided in said nozzle body and extends through said nozzle body in proximity to said nozzle body mastic passage; one end of said nozzle body conditioning fluid passage opens in a sealing surface of the nozzle body and the other end thereof opens in an exterior surface of the nozzle body; the other end of the nozzle body mastic passage opens in said nozzle body sealing surface; the end body and nozzle body are fixedly secured together with said end body sealing surface in flush sealing contiguous relation to said nozzle body sealing surface, the other end of said end body conditioning fluid passage in sealing communication with said one end of said nozzle body conditioning fluid passage, and the other end of said end body mastic passage in sealing communication with said other end of said nozzle body mastic passage; and said other end of said nozzle body conditioning fluid passage is in communication with a source of conditioning fluid.

11. A mastic applicator system according to claim 10 wherein:

said exterior surface of said nozzle body constitutes a portion of the sealing surface of said nozzle body so that said other end of said nozzle body conditioning fluid passage also opens in said nozzle body sealing surface;

said end body defines a further internal conditioning fluid passage opening at one end thereof in said end body sealing surface and opening at its other end in an exterior surface of the end body;

with said end body and said nozzle body secured together with said sealing surfaces in flush, sealing, contiguous relation, said one end of said further end body conditioning fluid passage is in sealing communication with said other end of said nozzle body conditioning fluid passage; and said other end of said further end body conditioning fluid passage is in communication with said source of conditioning fluid.

12. A mastic applicator system according to claim 10 wherein:

said sealing surfaces constitute flat surfaces; and one of said bodies includes a fitting projecting from the sealing surface thereof in surrounding relation to the mastic passage opening in that surface and the other of said bodies defines a blind bore in the sealing surface thereof in surrounding relation to the mastic passage opening in that surface and sized to sealingly receive said fitting.

13. A mastic applicator system according to claim 12 wherein:

said one body comprises said end body and said other body comprises said nozzle body.

14. In an applicator system for applying a mastic bead to a surface, the system comprising a conduit assembly including a mastic passage, an end body secured to the conduit assembly and including a mastic passage communicating with the conduit assembly mastic passage and a nozzle assembly including a nozzle body defining a mastic passage communicating with the mastic passage of the end body and a nozzle for receipt and dispensing of mastic fluid flowing through the mastic passage of the nozzle body, the improvement comprising:

the system includes conditioning means for maintaining the mastic flowing through the conduit assembly, end body, and nozzle body at a predetermined temperature, the conditioning means comprising a conditioning fluid passage arranged proximate the mastic passage of the conduit assembly, a conditioning fluid passage arranged proximate the mastic passage of the end body and communicating with the conditioning fluid passage of the conduit assembly, and a conditioning fluid passage arranged proximate the mastic passage of the nozzle assembly and communicating with the conditioning fluid passage of the end body; and the nozzle is operative to generate a plurality of streams of mastic which are spaced apart by a distance calculated to enable the streams to coact upon impact with the surface, and with the mastic maintained at the predetermined temperature, to form a single continuous bead of substantially uniform height.

15. A mastic applicator system including a conduit assembly including a mastic conduit for carrying mastic and a conditioning fluid conduit paralleling the mastic conduit in close proximity thereto so that conditioning fluid flowing through the conditioning fluid conduit may condition the mastic fluid with the mastic flowing through the mastic conduit; and a nozzle assembly for delivering mastic to a surface and including a nozzle defining a nozzle outlet and a nozzle body defining an internal mastic passage communicating at one end thereof with the nozzle outlet, the improvement comprising:

a conditioning fluid internal passage extends through said nozzle body in proximity to said nozzle body mastic passage;

the other end of the nozzle body mastic passage opens in a nozzle body exterior surface;

said conduit assembly is secured to said exterior surface of said nozzle body with one end of said conduit assembly mastic conduit in sealing communication with the other end of the nozzle body mastic passage and one end of said conduit assembly conditioning fluid conduit in sealing communication with one end of said nozzle body conditioning passage;

the other end of said nozzle body conditioning fluid passage communicates with a source of conditioning fluid;

the conduit assembly includes an end body;

the conduit assembly mastic conduit includes a mastic passage extending through said end body and opening at one end thereof in a sealing surface of the end body to define said one end of said conduit assembly mastic passage;

said conduit assembly conditioning fluid conduit includes a conditioning fluid passage extending through said end body and opening at one end thereof in said end body sealing surface to define said one end of said conduit assembly conditioning fluid conduit;

said exterior surface of said nozzle body constitutes a sealing surface; and said end body and said nozzle body are fixedly secured together with said sealing surfaces in flush sealing contiguous relation, said one end of said nozzle body conditioning fluid passage in sealing communication with said one end of said end body conditioning fluid passage, and the other end of said nozzle body mastic passage in sealing communication with said one end of said end body mastic passage.

16. A mastic applicator system according to claim 15 wherein:

said one end of said nozzle body conditioning fluid passage opens in said nozzle body sealing surface;

said end body defines a further internal conditioning fluid passage opening at one end thereof in said end body sealing surface and opening at its other end in a further surface of the end body;

said one end of said further end body conditioning fluid passage is in sealing communication with said other end of said nozzle body conditioning fluid passage; and said other end of said further end body conditioning fluid passage is in communication with said source of conditioning fluid.

17. A mastic applicator system according to claim 16 wherein:

said end body has a block configuration and includes a circular fitting at one side face thereof;

the other end of said end body mastic passage opens in said one side face of said end body in said circular fitting;

said conditioning fluid conduit includes an outer hose positioned at one end on said circular fitting;

said mastic conduit includes a central inner hose positioned within said outer hose, communicating with said other end of said end body mastic passage, and defining an annular chamber with said outer hose; and the other end of said end body conditioning fluid passage communicates with said annular chamber.

* * * * *